United States Patent [19]

Lau et al.

[11] 4,174,071

[45] Nov. 13, 1979

[54] SPRAY GUN ASSEMBLY

[75] Inventors: George W. Lau, Blue Island; Edward J. Bujnowski, Chicago, both of Ill.

[73] Assignee: Binks Manufacturing Company, Franklin Park, Ill.

[21] Appl. No.: 740,121

[22] Filed: Nov. 8, 1976

[51] Int. Cl.[2] ..... B05B 7/30

[52] U.S. Cl. ..... 239/348; 239/365

[58] Field of Search ..... 239/346, 364–368, 239/347, 348

[56] References Cited

U.S. PATENT DOCUMENTS

| | | | |
|---|---|---|---|
| 361,010 | 4/1887 | Houchin et al. | 239/365 X |
| 1,104,217 | 7/1914 | Paasche | 239/365 X |
| 1,682,037 | 8/1928 | Craig | 239/365 X |
| 1,822,743 | 9/1931 | Mitchell | 239/366 X |
| 1,875,729 | 9/1932 | Hermann | 239/366 X |
| 2,399,081 | 4/1946 | Vose | 239/348 |
| 2,499,447 | 3/1950 | Axelson et al. | 239/365 X |
| 2,609,233 | 9/1952 | Stearman | 239/366 X |
| 2,713,510 | 7/1955 | Coanda | 239/348 X |
| 3,107,059 | 10/1963 | Frechette | 239/348 |
| 3,132,806 | 5/1964 | McNair et al. | 239/366 X |
| 3,157,360 | 11/1964 | Heard | 239/365 X |

FOREIGN PATENT DOCUMENTS

| | | | |
|---|---|---|---|
| 330022 | 6/1930 | United Kingdom | 239/348 |

*Primary Examiner*—Robert W. Saifer

*Attorney, Agent, or Firm*—Gary, Juettner & Pyle

[57] ABSTRACT

An improved paint spray gun assembly of the syphon type having a vented paint supply container, is characterized by a conduit connectable either between the container vent and a compressed air inlet to the gun, or between the vent and a fitting remote therefrom and open to atmosphere. With either connection, the conduit prevents dripping of paint from the vent upon manipulation of the gun by an operator, and with the connection of the vent with the compressed air a positive pressure is generated within the container to increase the paint flow rate from the gun.

4 Claims, 4 Drawing Figures

Fig. 1.
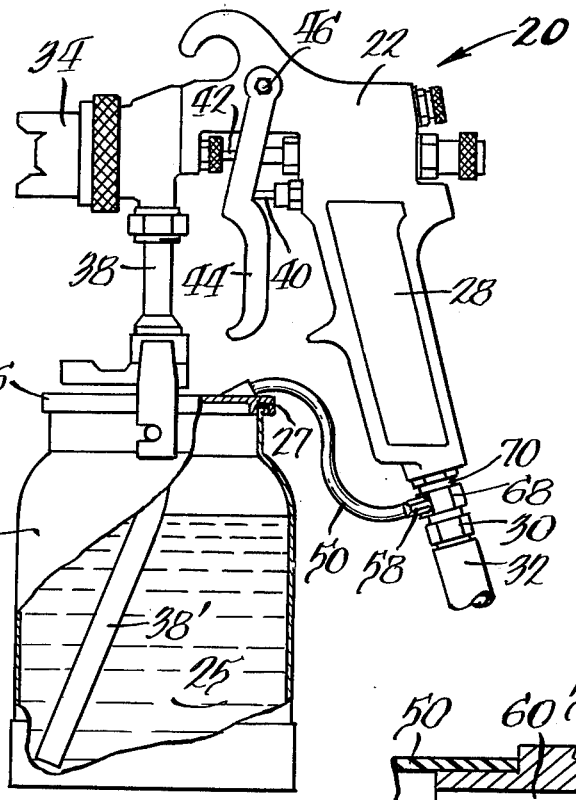
Fig. 3.
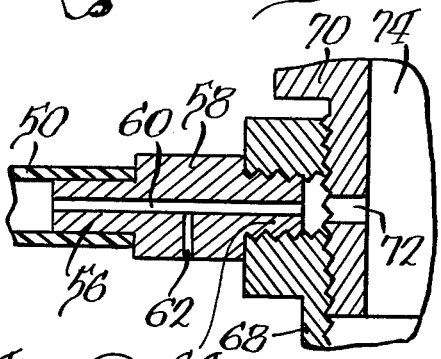
Fig. 2.
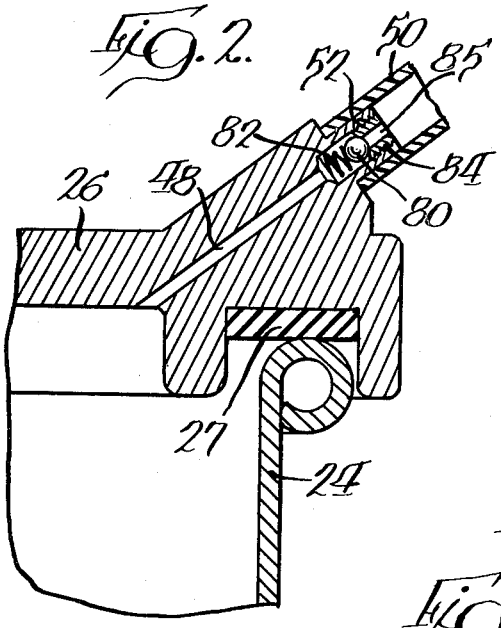
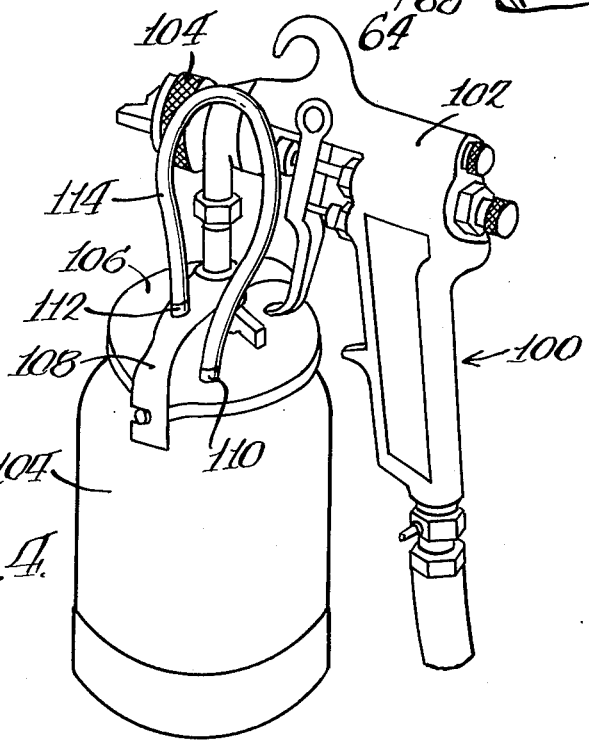
Fig. 4.

SPRAY GUN ASSEMBLY

BACKGROUND OF THE INVENTION

The present invention relates to an improved spray gun of the syphon cup type, and in particular to such a spray gun having a vented fluid supply container and means connected with the vent for preventing dripping of fluid therefrom upon movement of the gun, and for selectively generating within the container a positive pressure to increase the fluid flow rate from the gun.

In the use of syphon cup type paint spray guns, paint is syphoned through a tube from a supply container into an air stream passing through the gun for discharge in a spray from an orifice in a nozzle of the gun. Since during spraying the volume of paint within the container decreases, the container is vented to atmosphere to prevent a negative pressure from developing therein, with a resultant failure of paint to be syphoned into the gun.

With such spray guns paint within the container may pass through the vent and drip therefrom upon manipulation of the gun. Such dripping is not only undesirable, but is intolerable where it falls upon and mars an otherwise smoothly painted ware. Furthermore, with such guns the paint flow rate or output therefrom is limited by the negative pressure which may be generated within the syphon tube by the stream of air passing over an end of the tube within the gun, and is often less than desired.

Accordingly, an object of the present invention is to provide an improved syphon cup type spray gun assembly which eliminates dripping of fluid from a vented supply container.

Another object of the invention is to provide a syphon cup type spray gun assembly operable to increase the fluid flow rate from the gun per unit of time.

SUMMARY OF THE INVENTION

In accordance with the present invention, an improved syphon cup type spray gun assembly including a spray gun and an associated supply container having a vent to atmosphere, is characterized by means for preventing dripping from the assembly of contents of the container which pass through the vent.

In one of the disclosed embodiments a conduit communicates at a first end thereof with the vent and extends at a second end thereof to a position remote from the vent. The second end of the conduit opens to ambient, whereby the container is vented to ambient through the vent and the conduit. Should the contents of the container pass through the vent with movement of the assembly, the conduit therearound confines the contents to the assembly to prevent dripping of the contents therefrom.

In another embodiment the conduit extends between the vent and a source of compressed air, whereby a positive pressure with respect to ambient is generated within the container to provide an increased flow rate of contents from the gun. To limit the pressure within the container to a predetermined value, a bleed port vents to atmosphere a portion of the compressed air sufficient to limit the container pressure to the predetermined value. As in the first embodiment, the conduit prevents dripping from the assembly of the contents of the container should the contents pass through the vent.

The above stated objects of the invention are thus attained with particular facility and economy. Other objects, advantages and features of the invention will become apparent from the following detailed description when taken in conjunction with the accompanying drawings.

BRIEF DESCRIPTION OF THE DRAWINGS

FIG. 1 is an elevation view, partially in cross-section, illustrating a syphon cup type spray gun assembly having a conduit extended between a vent in a fluid supply container and a source of compressed air, in accordance with one embodiment of the invention;

FIG. 2 is a cross-sectional view of a portion of the container, showing an arrangement of a vent through a cover thereof;

FIG. 3 is a cross-sectional view of a fitting connectable between the conduit and the source of compressed air, and having an air bleed port for limiting the pressure in the container to a predetermined value, and FIG. 4 is a perspective view of a syphon cup type spray gun assembly, showing a conduit extended between a vent in a fluid supply container and a fitting remote therefrom and open to ambient, in accordance with another embodiment of the invention.

DETAILED DESCRIPTION

Referring to FIG. 1 of the drawings, there is shown in accordance with one embodiment of the invention a syphon cup type paint spray gun assembly, indicated generally at 20, including a spray gun 22, a container 24 having a supply of paint 25 therein, and a top closure lid 26 which substantially closes the upper end of the container with the aid of a seal 27. The gun includes a handle 28 connected at a lower end thereof with a source of compressed air (not shown) through a fitting 30 and a supply line 32, and a nozzle 34 having an orifice from which paint drawn from the container through a syphon tube 38 is emitted in a spray. The tube has a lower extension 38' projecting into the container to adjacent the bottom thereof, and upon passage of air past an upper end thereof within the gun, paint is drawn therethrough and into the gun by Venturi effect. To control the spraying operation, the gun includes a valve means 40 movable between open and closed positions to control a flow of pressurized air through the gun, a valve means 42 movable between open and closed positions to control a flow of paint to the orifice, and a manually manipulable trigger 44 operably connected with the valve means 40 and 42. The trigger is pivotally mounted at its upper end by a pivot pin 46, and is manually movable between a gun off position away from the handle 28 whereat the valve means are closed, to a gun on position toward the handle whereat the valve means are open and a spray of paint is emitted from the gun.

The assembly thus far described is known in the art, and when operated in a known manner the container 24 is vented to atmosphere, as by a vent passage 48 formed through the lid 26. The vent opens the container to atmosphere to prevent a negative pressure from developing therewithin as paint is drawn through the syphon tube, which negative pressure would otherwise ultimately stop the syphoning action. In the use of such a spray gun, it often happens that paint flows or passes through the vent and drips therefrom during manipulation of the gun by an operator, which dripping can mar an otherwise smoothly painted ware. Also, the flow rate of paint from the gun is limited by the negative pressure which may be generated at the upper end of the syphon tube for drawing the paint from the container.

In the present embodiment of the invention, the improved spray gun assembly both eliminates undesirable dripping of paint from the vent, and increases the flow rate of paint from the gun, by the connection of a conduit, hose, or air supply line 50 between the vent and the compressed air at the inlet to the gun. The hose encloses the vent exteriorly of the container to prevent dripping of paint therefrom, and provides within the container a positive pressure with respect to atmosphere to aid in delivery of paint through the syphon tube to increase the flow rate of paint from the gun.

Referring to FIG. 2, the conduit is preferably a rubber or plastic hose, and is slidingly positioned at a first end thereof around a cylindrical projection of housing portion 52 of the lid 26 through which the vent extends. The outer diameter of the projection 52 and the inner diameter of the hose are selected so that the hose adheres to and remains around the projection whenever the pressure within the container is less than a predetermined value, and is blown or forced off of the projection whenever the pressure becomes excessive. This ensures that the pressure within the container never exceeds a predetermined, safe value at which, for example, there is no danger of rupture or bursting of the container. To further ensure against rupture of the container, the hose is of a strength to burst, and the seal 27 is sufficiently resilient to leak air therepast, well before the pressure within the container approaches an unsafe value.

Referring also to FIG. 3, the compressed air at the inlet to the gun is connected with the interior of the container through the vent by slidingly positioning a second and opposite end of the hose 50 around a cylindrical outlet portion 56 of a fitting 58. The fitting has a restricted air passage 60 formed longitudinally therethrough, and a restricted air bleed port or vent 62 communicating with the passage 60. A threaded end portion 64 of the fitting 58 is engaged with a fitting 68 fastened between the fitting 30 and an inlet fitting 70 to the gun, and a passage 72 formed through the fitting 70 provides communication between a central compressed air supply passage 74 therethrough and the passage 60. Similar to the connection of the hose to the projection 52 on the canister lid, the relative diameters of the interior of the hose and the exterior of the outlet 56 are selected so that the second end of the hose will be blown therefrom if the pressure within the container becomes excessive.

With the connections shown, compressed air from the line 32 is applied through the passages 72 and 60, the supply hose 50 and the vent 48, to the interior of the container 24 to generate a positive pressure with respect to atmosphere within the container. Simultaneously, at least a portion of the air entering the passage 60 is exhausted or vented to atmosphere through the air bleed port 62, which opens to atmosphere to otherwise closed pressure system and limits the pressure developed within the container to a predetermined value, which absent the bleed port would increase to the pressure within the supply line 32.

Conventionally, the pressure of the air within the line 32 is regulated to a fixed value. Therefore, under static conditions when paint is not being drawn from the container and sprayed from the gun 22, and for all practical purposes under operating conditions when paint is being slowly removed from the container, the pressure developed within the container is a function of the combination of (a) the pressure of the air within the line 32; (b) the cross-sectional or fluid flow area of the restricted passage 60, and (c) the cross-sectional or fluid flow area of the air bleed port 62. For a given air supply pressure, the relative cross-sectional areas of the passage 60 and the port 62 are ordinarly chosen to develop within the container 24 a positive pressure of a predetermined value which is well below that pressure at which danger of rupturing the container exists, yet which is sufficient to elevate the head of paint within the syphon tube above the level of the supply of paint 25, but below the upper end of the tube within the gun. This increases the flow rate of paint from the gun by decreasing the vertical distance through which the paint must be drawn by Venturi effect at the upper end of the tube.

Should air pressure provided to the vent suddenly be lost, perhaps by failure of the source of compressed air or disconnection of an end of the hose 50, a one-way valve means is provided in the vent for preventing movement of paint therethrough and into the air line by pressure within the container should the container at that time be tilted so that paint is present at the inner end of the vent. The valve means may include, by way of example only, a ball valve 80 within an enlarged outer chamber portion of the vent, which is normally lightly urged by a spring 82 against a valve seat formed in a valve housing 84 fastened within the outermost end of the vent chamber and having a passage 85 formed therethrough.

In the normal operation of the spray gun, the air within the hose and passage 85 has sufficient pressure to move the lightly biased valve ball from the valve seat, and to thereby pressurize the interior of the container. However, should the pressure be lost within the passage 85, the pressure within the container will sealingly urge the valve ball against the valve seat, thereby to prevent any possible movement of paint through the vent by the pressure within the container.

The above-described embodiment of the invention thus provides an improved spray gun assembly of the syphon cup type, which is dripless and of increased paint flow capacity. The predetermined positive pressure provided in the container increases the paint output from the gun, and the hose encloses the container vent to eliminate dripping of paint which might pass therethrough upon operator manipulation of the gun. By controlling the strength of the connections at opposite ends of the hose, as well as the burst strength of the hose, the assembly may be operated without danger of rupturing the container, and as compared with conventional syphon cup type spray guns having unpressurized containers with open vents, increases of 50%–70% in paint flow rates are obtained.

In accordance with another embodiment of the invention, the spray gun assembly is operated solely by syphon without a pressurized paint container, yet in a dripless fashion.

Referring to FIG. 4, a syphon cup type spray gun assembly, indicated generally at 100, includes a paint spray gun 102 having a paint supply container from which paint is drawn by syphon for discharge in a spray from an orifice in a nozzle 104 of the gun. The container includes a lid 106 for closing the container with the lid, and therethrough the container, being fastened beneath the gun by a yoke 108. The interior of the container 104 is vented through a fitting 110 on the lid, and a fitting 112 on the yoke communicates with the atmosphere through the yoke.

To prevent dripping of paint which might pass through the vent in the container a conduit 114, which is preferably a rubber or plastic hose, is extended at opposite ends thereof around the between the fittings 110 and 112. The conduit encloses the fitting 110 exterior of the lid and container to confine and prevent from dripping any paint which might pass through the vent upon manipulation of the spray gun assembly, yet nevertheless provides for venting to atmosphere of the container through the fitting 110, the conduit, and the fitting 112, the fitting 112 thus serving to generally immobilize, yet open to atmosphere, the end of the conduit away from the fitting 110. In the alternative, the fitting 112 may, if desired, be eliminated, with the conduit in this case then extending upward from a first end thereof around the fitting 110 to a second end thereof open to atmosphere.

While embodiments of the invention have been described in detail, it is understood that other modifications and various embodiments thereof may be devised by one skilled in the art without departing from the spirit and the scope of the invention, as defined by the claims.

We claim:

1. A syphon-type spray gun assembly including a spray gun and an associated container for holding contents to be syphoned therefrom, means for generating within said container a positive pressure with respect to ambient to urge the contents toward said gun, and means for limiting the pressure generated within said container to a predetermined value which is less than sufficient to move the contents into said gun, said container having a vent formed through a portion thereof not normally contacting the contents, said means for generating said pressure including means for connecting air under pressure with said vent, said means for limiting said pressure to said predetermined value including means for venting to atmosphere a portion of said connected air, said gun having an air inlet for receiving air under pressure to draw contents from said container by syphon and to be discharged from said gun with the contents, said means for connecting air under pressure to said vent including conduit means for connecting said air under pressure at said inlet with said vent, said means for venting comprising a passage through said conduit means for continuously venting to atmosphere a portion of said connected air whenever air is received at said air inlet to maintain said pressure in said container at said predetermined value and less than the pressure of air at said air inlet both when contents are and are not being discharged from said gun.

2. An improved syphon cup type paint spray gun assembly of a type including a spray paint gun and an associated container for paint to be syphoned into said gun through a tube extended between said container and said gun in response to a flow of air from an air inlet to said gun past an end of said tube within said gun for discharge with the air from said gun in a spray upon operation of said gun, said container having a vent formed through a portion thereof not normally contacting said paint, the improvement comprising means connected with said vent exterior of said container for preventing passage of paint through said vent to exterior of said assembly upon manipulation of said assembly by an operator thereof, whereby paint is prevented from dripping from said assembly, said means connected with said vent for preventing passage of paint therethrough including means for applying air under pressure into said container through said vent to generate therewithin a positive pressure with respect to ambient to urge the paint through said tube toward said gun, but not into said gun, to thereby increase the flow rate of paint to said gun upon operation thereof, said means for applying air under pressure including means for connecting air under pressure at said air inlet with said container vent, said connecting means including a conduit connected between said air inlet and said vent, and means for venting to ambient from said conduit a controlled volume of air from said inlet sufficient to limit the pressure within said container to a predetermined value, said vent terminating in a cylindrical housing exterior of said container, said connecting means including a fitting connected with said air inlet and having an air passage extending from said air inlet to a cylindrical housing portion thereof for passing therethrough from said inlet a volume of air in accordance with the cross-sectional area thereof, said conduit being a flexible tubular air supply line extended at one end thereof around said cylindrical vent housing and at an opposite end thereof around said cylindrical fitting housing for connecting, along with said air passage through said fitting, air at said inlet to said container vent, the inner diameter of said supply line and the outer diameter of at least one of said cylindrical housings being selected such that said line is held on said housing with a force less than sufficient to hold said end thereon when the pressure within said container exceeds a predetermined maximum value, said supply line around said vent housing containing any paint passing through said vent upon movement of said spray gun assembly by an operator thereof.

3. An improved syphon cup type spray gun assembly comprising a spray paint gun and an associated container for paint to be syphoned into said gun through a tube extended between said container and said gun in response to a flow of air from an air inlet to said gun past an end of said tube within said gun for discharge with the air from said gun in a spray upon operation of said gun, said container having a vent formed through a portion thereof not normally contacting said paint, and means connected with said vent exterior of said container for preventing passage of paint through said vent upon manipulation of said spray gun assembly by an operator thereof and for applying air under pressure into said container through said vent to generate therewithin a positive pressure with respect to ambient to urge said paint through said tube toward said gun to thereby increase the flow rate of paint to, and therefore from, said gun upon operation thereof, said means for applying air under pressure including a conduit connecting air under pressure at said air inlet with said container vent and means for venting to ambient from said conduit a controlled volume of air from said inlet sufficient to limit the pressure within said container to a predetermined value, said vent terminating in a cylindrical housing exterior of said container, and including a fitting connected with said air inlet and having an air passage extending from said air inlet to a cylindrical housing portion thereof for passing therethrough from said inlet a volume of air in accordance with the cross-sectional area thereof, said conduit being a flexible tubular air supply line extended at one end thereof around said cylindrical vent housing and at an opposite end thereof around said cylindrical fitting housing for connecting, along with said air passage through said fitting, air at said inlet to said container vent, the inner diameter of said supply line and the outer diameter of at least one of said cylindrical housings being selected such that said line is held on said housing with a force less than sufficient to hold said end thereon when the pressure within said container exceeds a predetermined maximum value, said supply line around said vent housing containing any paint passing through said vent upon movement of said spray gun assembly by an operator thereof, said means for venting including an air bleed port formed through said fitting between said air passage and ambient for venting to ambient a portion of the air in said air passage from said air inlet of a volume in accordance with the cross-sectional areas of said vent passage and said air passage, said cross-sectional areas being selected to limit the pressure in said supply line and thereby in said container to said predetermined value.

4. An improved spray gun assembly as set forth in claim 3, said air bleed port connecting orthogonally with said air passage.

* * * * *